US007273360B2

(12) United States Patent
Shinoda et al.

(10) Patent No.: US 7,273,360 B2
(45) Date of Patent: Sep. 25, 2007

(54) VANE-TYPE HYDRAULIC MOTOR

(75) Inventors: Masao Shinoda, Fujisawa (JP); Chishiro Yamashita, Fujisawa (JP); Shimpei Miyakawa, Fujisawa (JP)

(73) Assignee: Ebara Corporation, Tokyo (JP)

( * ) Notice: Subject to any disclaimer, the term of this patent is extended or adjusted under 35 U.S.C. 154(b) by 131 days.

(21) Appl. No.: 10/525,009

(22) PCT Filed: Aug. 12, 2003

(86) PCT No.: PCT/JP03/10248

§ 371 (c)(1),
(2), (4) Date: Sep. 2, 2005

(87) PCT Pub. No.: WO2004/018871

PCT Pub. Date: Mar. 4, 2004

(65) Prior Publication Data

US 2006/0104847 A1 May 18, 2006

(30) Foreign Application Priority Data

Aug. 21, 2002 (JP) ..... 2002-240987

(51) Int. Cl.
*F03C 2/00* (2006.01)
*F04C 2/00* (2006.01)

(52) U.S. Cl. ..... 418/15; 418/259; 418/260

(58) Field of Classification Search ..... 418/15, 418/133, 259, 260, 268
See application file for complete search history.

(56) References Cited

U.S. PATENT DOCUMENTS

| | | | | |
|---|---|---|---|---|
| 2,463,155 A * | 3/1949 | Dawes | ..... | 418/259 |
| 4,963,080 A * | 10/1990 | Hansen | ..... | 418/268 |
| 7,056,107 B2 * | 6/2006 | Shinoda et al. | ..... | 418/15 |

FOREIGN PATENT DOCUMENTS

| | | | | |
|---|---|---|---|---|
| EP | 1113175 A1 * | 7/2001 | ..... | 418/102 |
| JP | 49-78902 | 7/1974 | | |
| JP | 52-6953 | 1/1975 | | |
| JP | 05164061 A * | 6/1993 | ..... | 418/131 |

* cited by examiner

*Primary Examiner*—Theresa Trieu
(74) *Attorney, Agent, or Firm*—Westerman, Hattori, Daniels & Adrian, LLP.

(57) ABSTRACT

A vane-type hydraulic motor includes a rotor (30) having a main shaft (70) and a plurality of vanes (35), a cam casing (10) having a chamber (11) for rotatably housing the rotor (30), a first port (13) and a second port (15) for supplying a working fluid into the chamber (11) and discharging the working fluid from the chamber (11). A bypass path (80) is provided for allowing the working fluid to flow from bearing portions (51, 61) supporting the main shaft (70). A drain port (17) is provided for discharging the working fluid to the exterior.

15 Claims, 9 Drawing Sheets

VANE-TYPE HYDRAULIC MOTOR

TECHNICAL FIELD

The present invention relates to a vane-type hydraulic motor, and more particularly to a vane-type hydraulic motor suitable for use in applications where a low-viscosity fluid such as water is used as a working fluid.

BACKGROUND ART

FIGS. 1A through 1C of the accompanying drawings show a structure of a balanced vane-type hydraulic motor. FIG. 1A is a schematic cross-sectional view taken along line IA-IA of FIG. 1B, FIG. 1B is a schematic cross-sectional view taken along line IB-IB of FIG. 1A, and FIG. 1C is a plan view showing a part of a cam casing 280 as viewed from above.

As shown in FIGS. 1A through 1C, the balanced vane-type hydraulic motor comprises a rotor 290 rotatably housed in a rotor-housing chamber 286 formed in a cam casing 280, a plurality of vanes 295 inserted in the rotor 290 and held in contact with an inner surface of the rotor-housing chamber 286, a front cover 300 and an end cover 310 for covering opposite sides of the rotor 290 and the vanes 295, and a main shaft 320 fixed to the rotor 290 and rotatably supported by bearings 301, 311 mounted respectively in the front cover 300 and the end cover 310. The cam casing 280 has a supply port 281 defined therein for supplying a pressurized fluid (i.e. a working fluid comprising a low-viscosity fluid such as water) into the rotor-housing chamber 286 of the cam casing 280. The cam casing 280 also has a return port 283 defined therein for discharging the fluid which has been supplied into the rotor-housing chamber 286. The supply port 281 and the return port 283 are connected to the rotor-housing chamber 286 through a fluid path (fluid-supply path) 282 and a fluid path (fluid-return path) 284, respectively.

When the pressurized fluid (working fluid) flows from the supply port 281 to the rotor-housing chamber 286, the pressurized fluid (working fluid) acts on the vanes 295 projecting from the rotor 290 to generate a torque, thereby rotating the rotor 290. After rotating the rotor 290, the working fluid is discharged from the return port 283.

In the balanced vane-type hydraulic motor using a low-viscosity fluid such as water as the working fluid, a bypass path 285 is provided to return the working fluid, that has leaked through the bearings 301, 311 provided on both sides of the rotor 290, to the return port 283, which is a low-pressure side. The working fluid in the rotor-housing chamber 286, which is a high-pressure side, passes through both side clearances (a gap between the rotor 290 and the front cover 300 and a gap between the rotor 290 and the end cover 310) S and gaps between the main shaft 340 and the bearings 301, 311, and is then led to the return port 283 through the bypass path 285. With this arrangement, the following advantages are obtained:

(1) The pressures applied to the both side surfaces of the rotor 290 are substantially equal to the pressure in the return port 283, and thus are held in a state of balance. Therefore, essentially no pressure acts on the rotor 290 in the thrust direction (the extending direction of the main shaft 320). The rotor 290 is balanced in the cam casing 280 in the thrust direction, thus making it possible to reduce the frictional loss (torque loss) due to the sliding motion between the rotor 290 and each of the front cover 300 and the end cover 310.

(2) Since the working fluid is led to the bearings 301, 311, the bearings 301, 311 can be prevented from being deteriorated even if the working fluid comprises a low-viscosity fluid such as water. Thus, the durability of the main shaft 320 and the bearings 301, 311 can be increased.

(3) Since an internal seal pressure P is small and the shaft seal 330 applies a small pressing force against the main shaft 320, no friction-induced mechanical loss is generated in this shaft seal region. In addition, the shaft seal 330 and the main shaft 320 do not suffer frictional wear, thus increasing the durability thereof.

(4) No liquid reservoir is formed around the bearings 301, 311, and the working fluid around the bearings 301, 311 circulates at all times. Therefore, the working fluid is prevented from being rotted and microorganisms are prevented from being produced in those regions.

A rotary actuator such as the above vane-type hydraulic motor is utilized in various kinds of apparatuses, and hence an output shaft (main shaft) of the rotary actuator is required to be rotated in one direction, the opposite direction, or the both directions depending on the operational conditions of the rotary actuator.

Generally, in the hydraulic motor, it is required to provide a pipe for supplying a pressurized fluid to actuate the hydraulic motor and another pipe for discharging the fluid from the hydraulic motor. The hydraulic motor has a supply port and a return port as a connection port for connecting the above pipes. In the vane-type hydraulic motor shown in FIGS. 1A through 1C, the supply port 281 and the return port 283 are provided in the cam casing 280.

In FIG. 1B, in the case where the hydraulic motor is rotated in the direction indicated by the arrow (i.e. the clockwise direction), piping is arranged such that the left port in FIG. 1B is used as the supply port 281 and the right port is used as the return port 283. Therefore, the hydraulic motor is assembled using a component serving as the cam casing 280 which has the right port (return port) 283 and the bypass path 285 communicating with each other as shown in FIG. 1B.

On the other hand, in the case where the hydraulic motor is rotated in the direction opposite to the direction indicated by the arrow shown in FIG. 1B (i.e. the counterclockwise direction), the right port in FIG. 1B is used as the supply port and the left port is used as the return port. Therefore, it is required to assemble the hydraulic motor using a component serving as the cam casing 280 which has a left port and a bypass path communicating with each other, unlike the component shown in FIG. 1B.

If the hydraulic motor is constructed such that the working fluid is supplied from the return port 283 shown in FIG. 1B and is discharged from the supply port 281 shown in FIG. 1B, then the internal seal pressure P is increased. Consequently, the damage to the shaft seal 330 or the wear on the main shaft 320 will be accelerated, and the durability of the shaft seal 330 will be deteriorated. Further, the effect of the bypass path 285 will be lowered, and other problems will arise. As a result, the hydraulic motor will fail to perform its function.

Consequently, the balanced vane-type hydraulic motor needs to have different components prepared for the respective rotational directions of the motor, and hence the manufacturing cost is increased.

DISCLOSURE OF INVENTION

It is therefore an object of the present invention to provide a dual-rotation vane-type hydraulic motor which can allow an output shaft (main shaft) to easily change the rotating direction thereof without replacing any components.

In order to achieve the above object, according to one aspect of the present invention, there is provided a vane-type hydraulic motor comprising: a rotor having a main shaft and a plurality of vanes; a cam casing having a chamber for rotatably housing the rotor; a first port and a second port for supplying a working fluid into the chamber and discharging the working fluid from the chamber; a bypass path for allowing the working fluid to flow from a bearing portion supporting the main shaft through the bypass path; and a drain port for discharging the working fluid to the exterior; wherein the drain port and the bypass path communicate with each other to allow the working fluid flowing from the bearing portion through the bypass path to be discharged from the drain port to the exterior.

In a preferred aspect of the present invention, the vane-type hydraulic motor further comprises: a block having a third port and a fourth port which communicate with the first port and the second port, respectively; and a port switching mechanism provided in the block for switching a flow direction of the working fluid to allow the bypass path to communicate with a low-pressure one of the third port and the fourth port.

In a preferred aspect of the present invention, the port switching mechanism comprises a rod pin insertion hole provided in the block and communicating with the bypass path, and a rod pin slidably inserted in the rod pin insertion hole, and the rod pin is moved depending on a differential pressure of the working fluid between the third port and the fourth port to allow the bypass path to communicate with a low-pressure one of the third port and the fourth port.

In a preferred aspect of the present invention, the rod pin insertion hole has a small-diameter portion having seal surfaces at both end portions thereof, the rod pin has seal surfaces facing the seal surfaces of the small-diameter portion, respectively, and when the rod pin is moved toward a low-pressure side, the seal surface of the rod pin at a high-pressure side is brought into contact with the seal surface of the small-diameter portion at a high-pressure side.

In a preferred aspect of the present invention, the seal surfaces of the small-diameter portion and the seal surfaces of the rod pin have a flat shape or a tapered shape.

In a preferred aspect of the present invention, at least one of the seal surfaces of the rod pin and the seal surfaces of the small-diameter portion comprises a resilient member.

In a preferred aspect of the present invention, at least a part of a surface of the rod pin which is brought into sliding contact with an inner circumferential surface of the rod pin insertion hole comprises a low-friction member.

In a preferred aspect of the present invention, the rod pin which is brought into sliding contact with an inner circumferential surface of the rod pin insertion hole has a groove.

According to another aspect of the present invention, there is provided a vane-type hydraulic motor comprising: a rotor having a main shaft and a plurality of vanes; a cam casing having a chamber for rotatably housing the rotor; a first port and a second port for supplying a working fluid into the chamber and discharging the working fluid from the chamber; a bypass path for allowing the working fluid to flow from a bearing portion supporting the main shaft through the bypass path; and a port switching mechanism for switching a flow direction of the working fluid to allow the bypass path to communicate with a low-pressure one of the first port and the second port.

In a preferred aspect of the present invention, the port switching mechanism comprises a rod pin insertion hole provided in the cam casing and communicating with the bypass path, and a rod pin slidably inserted in the rod pin insertion hole, and the rod pin is moved depending on a differential pressure of the working fluid between the first port and the second port to allow the bypass path to communicate with a low-pressure one of the first port and the second port.

In a preferred aspect of the present invention, the rod pin insertion hole has a small-diameter portion having seal surfaces at both end portions thereof, the rod pin has seal surfaces facing the seal surfaces of the small-diameter portion, respectively, and when the rod pin is moved toward a low-pressure side, the seal surface of the rod pin at a high-pressure side is brought into contact with the seal surface of the small-diameter portion at a high-pressure side.

In a preferred aspect of the present invention, the seal surfaces of the small-diameter portion and the seal surfaces of the rod pin have a flat shape or a tapered shape.

In a preferred aspect of the present invention, at least one of the seal surfaces of the rod pin and the seal surfaces of the small-diameter portion comprises a resilient member.

In a preferred aspect of the present invention, at least a part of a surface of the rod pin which is brought into sliding contact with an inner circumferential surface of the rod pin insertion hole comprises a low-friction member.

In a preferred aspect of the present invention, the rod pin which is brought into sliding contact with an inner circumferential surface of the rod pin insertion hole has a groove.

BEST MODE FOR CARRYING OUT THE INVENTION

A vane-type hydraulic motor according to embodiments of the present invention will be described below with reference to the drawings.

Figure 1A:
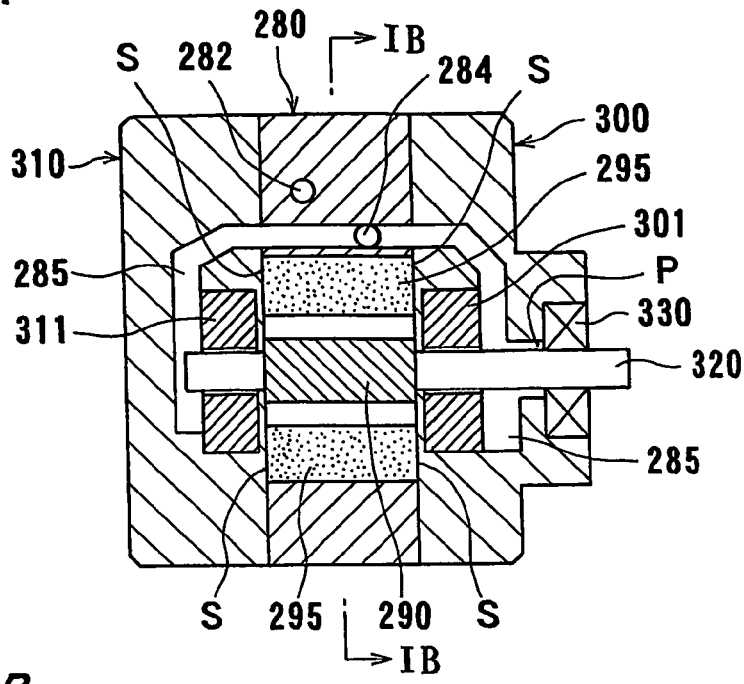
FIGS. 1A through 1C show a structure of a conventional balanced vane-type hydraulic motor, FIG. 1A being a schematic cross-sectional view taken along line IA-IA of FIG. 1B, FIG. 1B being a schematic cross-sectional view taken along line IB-IB of FIG. 1A, and FIG. 1C being a plan view showing a part of a cam casing 280 as viewed from above.
Figure 1B:
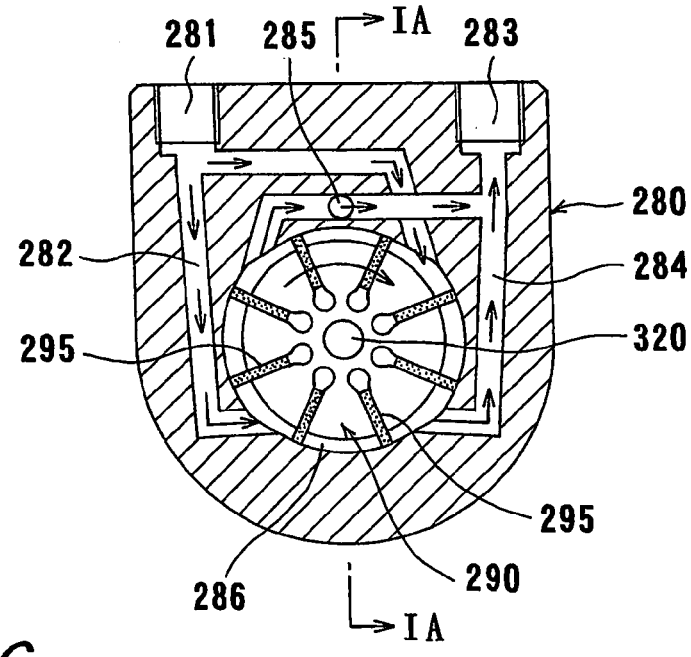
Figure 1C:
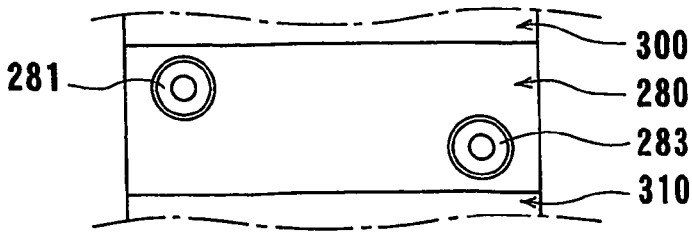
Figure 2A:
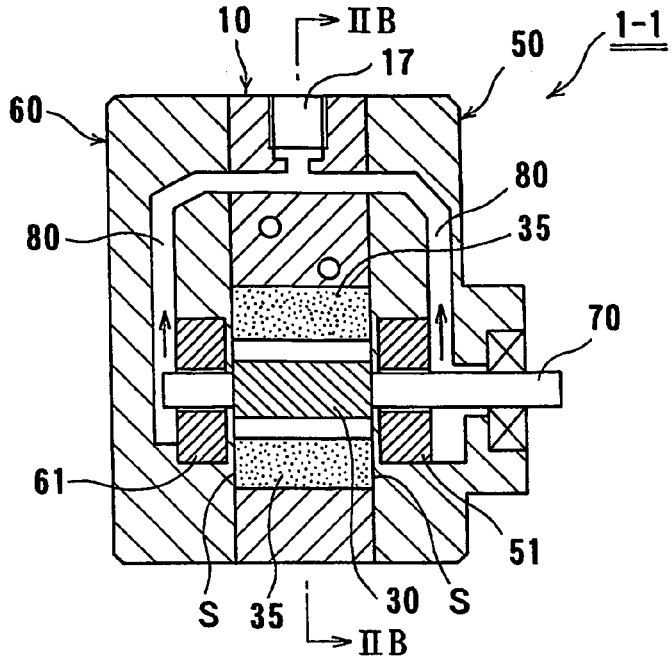
FIGS. 2A through 2C show a dual-rotation vane-type hydraulic motor 1-1 according to a first embodiment of the present invention, FIG. 2A being a schematic cross-sectional view taken along line IIA-IIA of FIG. 2B, FIG. 2B being a schematic cross-sectional view taken along line IIB-IIB of FIG. 2A and showing a state in which the vane-type hydraulic motor is rotated in a clockwise direction, and FIG. 2C being a plan view showing the vane-type hydraulic motor in FIG. 2B as viewed from above (showing a cam casing 10 only)
Figure 2B:
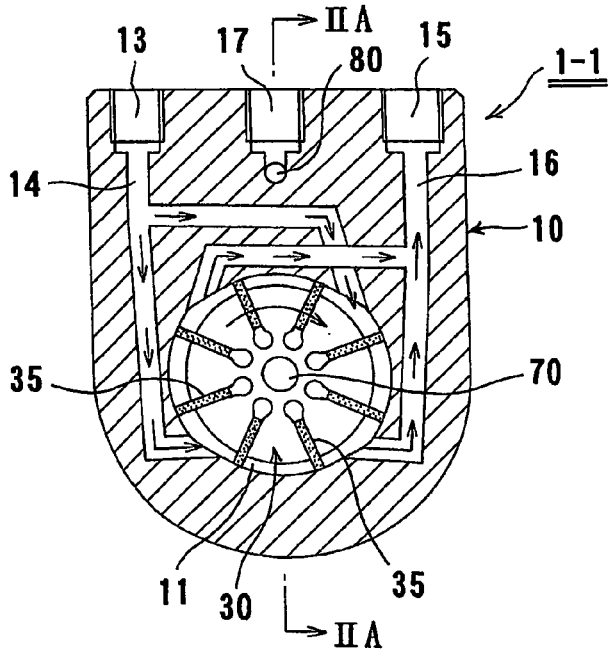
Figure 2C:
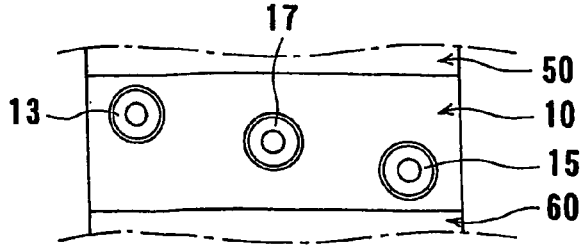

FIGS. 2A through 2C show a dual-rotation vane-type hydraulic motor according to a first embodiment of the present invention. FIG. 2A is a schematic cross-sectional view taken along line IIA-IIA of FIG. 2B. FIG. 2B is a schematic cross-sectional view taken along line IIB-IIB of FIG. 2A. FIG. 2C is a plan view showing the vane-type hydraulic motor in FIG. 2B as viewed from above (showing a cam casing 10 only).

As shown in FIGS. 2A through 2C, a vane-type hydraulic motor 1-1 comprises a rotor 30 rotatably housed in a rotor-housing chamber 11 formed in a cam casing 10, a plurality of vanes 35 inserted in the rotor 30 and held in contact with an inner surface of the cam casing 10, a front cover 50 and an end cover 60 for covering opposite sides of the rotor 30 and the vanes 35, and a main shaft 70 fixed to the rotor 30 and rotatably supported by bearings 51, 61 mounted respectively in the front cover 50 and the end cover 60. The cam casing 10 has a first port 13 and a second port 15 defined therein as inlet/outlet ports for supplying and discharging a pressurized fluid (i.e. a working fluid comprising a low-viscosity fluid such as water) into and from the rotor-housing chamber 11 of the cam casing 10. The first port 13 and the second port 15 are connected to the rotor-housing chamber 11 through a fluid path 14 and a fluid path 16, respectively.

The vane-type hydraulic motor 1-1 has a bypass path 80 for returning the working fluid, that has leaked through the bearings 51, 61 disposed on both sides of the rotor 30, to a low-pressure side. The working fluid in the rotor-housing chamber 11, which is a high-pressure side, passes through both side clearances (a gap between the rotor 30 and the front cover 50 and a gap between the rotor 30 and the end cover 60) S and gaps between the main shaft 70 and the bearings (bearing portions) 51, 61, and is then led from the bypass path 80 to a drain port 17 described below. The reason for providing the bypass path 80 is the same as the reason described in the background art.

In this embodiment, the cam casing 10 has the drain port 17 in addition to the first port 13 and the second port 15, and the drain port 17 communicates with the above bypass path 80. The drain port 17 is provided to discharge the working fluid from the bypass path 80 to the exterior. For example, a pipe (not shown) is connected to the drain port 17 so that the working fluid which has passed through the bearings 51, 61 is returned to a working-fluid storing tank (not shown) disposed separately from the vane-type hydraulic motor 1-1. Pipes connected to the first port 13 and the second port 15 are also connected to the working-fluid storing tank. By supplying the working fluid selectively to the first port 13 or the second port 15, the vane-type hydraulic motor 1-1 (the main shaft 70) can be rotated in one direction and the opposite direction. Specifically, by switching the supply direction of the working fluid, the vane-type hydraulic motor 1-1 can be rotated selectively in both directions. Next, this dual-rotation structure will be described in detail.

As shown in FIG. 2B, a supply pipe (not shown) and a return pipe (not shown) are connected to the first port 13 and the second port 15, respectively, such that the first port 13 is used as a supply port for supplying the working fluid and the second port 15 is used as a return port for discharging the working fluid. The pressurized fluid (working fluid) flows from the first port 13 into the rotor-housing chamber 11 of the cam casing 10, and acts on the vanes 35 projecting from the rotor 30 to generate a torque, thereby rotating the rotor 30 in the direction indicated by the arrow (the clockwise direction). After rotating the rotor 30, the working fluid is discharged from the second port 15.

Figure 3:
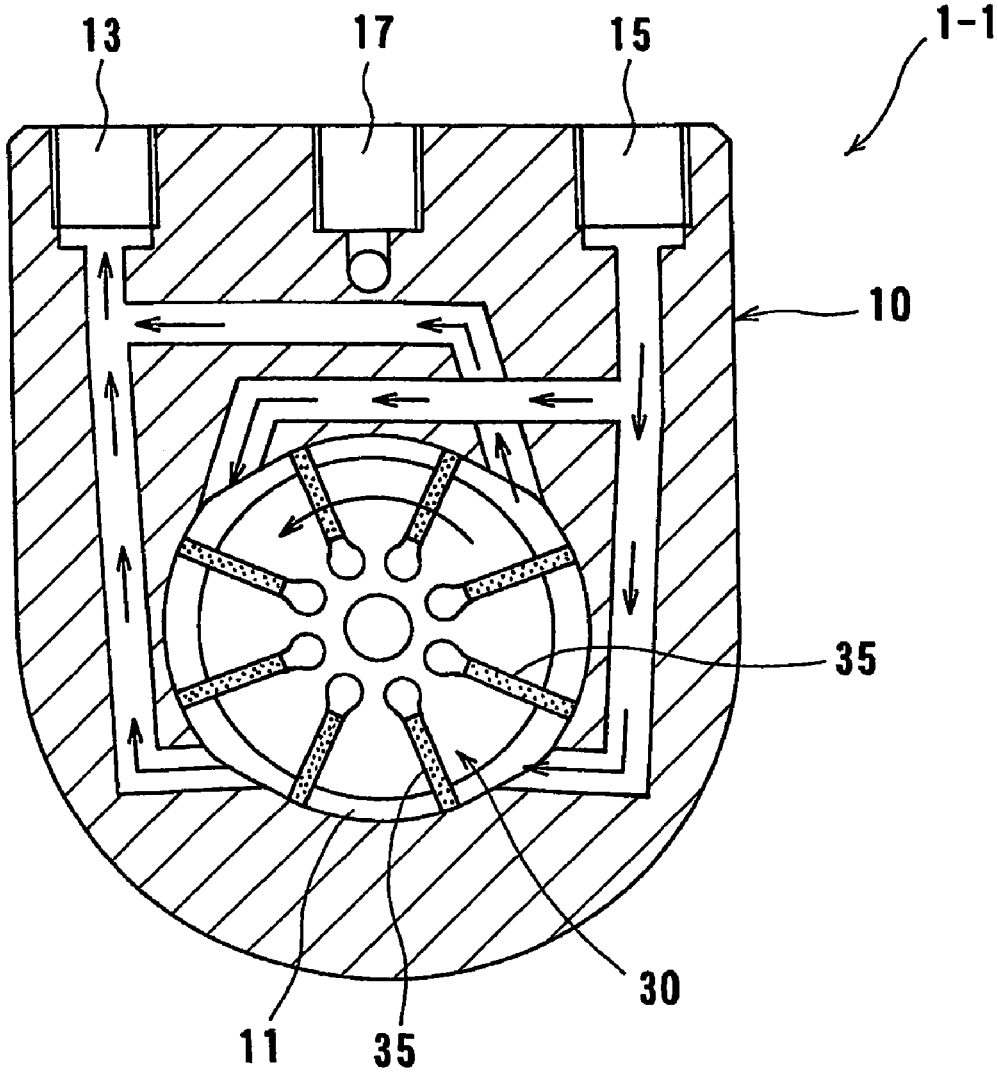
FIG. 3 is a schematic cross-sectional view showing a state in which the vane-type hydraulic motor 1-1 shown in FIG. 2B is rotated in a counterclockwise direction.

On the other hand, in FIG. 3, the return pipe and the supply pipe are connected to the first port 13 and the second port 15, respectively, such that the first port 13 is used as a return port for discharging the working fluid and the second port 15 is used as a supply port for supplying the working fluid. In this case, the pressurized fluid (working fluid) flows from the second port 15 into the rotor-housing chamber 11 of the cam casing 10, and acts on the vanes 35 projecting from the rotor 30 to generate a torque, thereby rotating the rotor 30 in the direction indicated by the arrow (the counterclockwise direction). After rotating the rotor 30, the working fluid is discharged from the first port 13.

Even when the rotor 30 is rotated in any direction, the working fluid in the rotor-housing chamber 11 passes through the side clearances S and the bearings (bearing portions) 51, 61, and flows into the bypass path 80. The working fluid is led from the bypass path 80 to the drain port 17, and is then returned to the working-fluid storing tank through the pipe connected to the drain port 17.

In this manner, the bypass path 80, which has heretofore been connected to the return port, is connected to the drain port 17 which is additionally provided so as to discharge the working fluid from the drain port 17 through the bypass path 80, independently. Specifically, the working fluid which has passed through the bypass path 80 is discharged from the drain port 17 to the exterior of the vane-type hydraulic motor 1-1 without being led to the return port. Therefore, the rotating direction of the motor can easily be changed simply by switching the pipes connected to the first port 13 and the second port 15 and by operating a valve such as a direction-switching valve connected to the pipes, without changing the structure of the cam casing 10.

A dual-rotation vane-type hydraulic motor according to a second embodiment of the present invention will be described below.

As described above, the dual-rotation vane-type hydraulic motor 1-1 according to the first embodiment has the drain port 17 in addition to the first port 13 and the second port 15. In this case, three types of pipes are required, thus causing the following problems:

(1) Because the number of pipes is increased, it is difficult to install the pipes when the vane-type hydraulic motor is installed in a limited space.

(2) The pipes require a large installation space.

(3) The installation cost of the pipes is increased because of an increased number of parts such as joints which are combined with the pipes.

Figure 4:
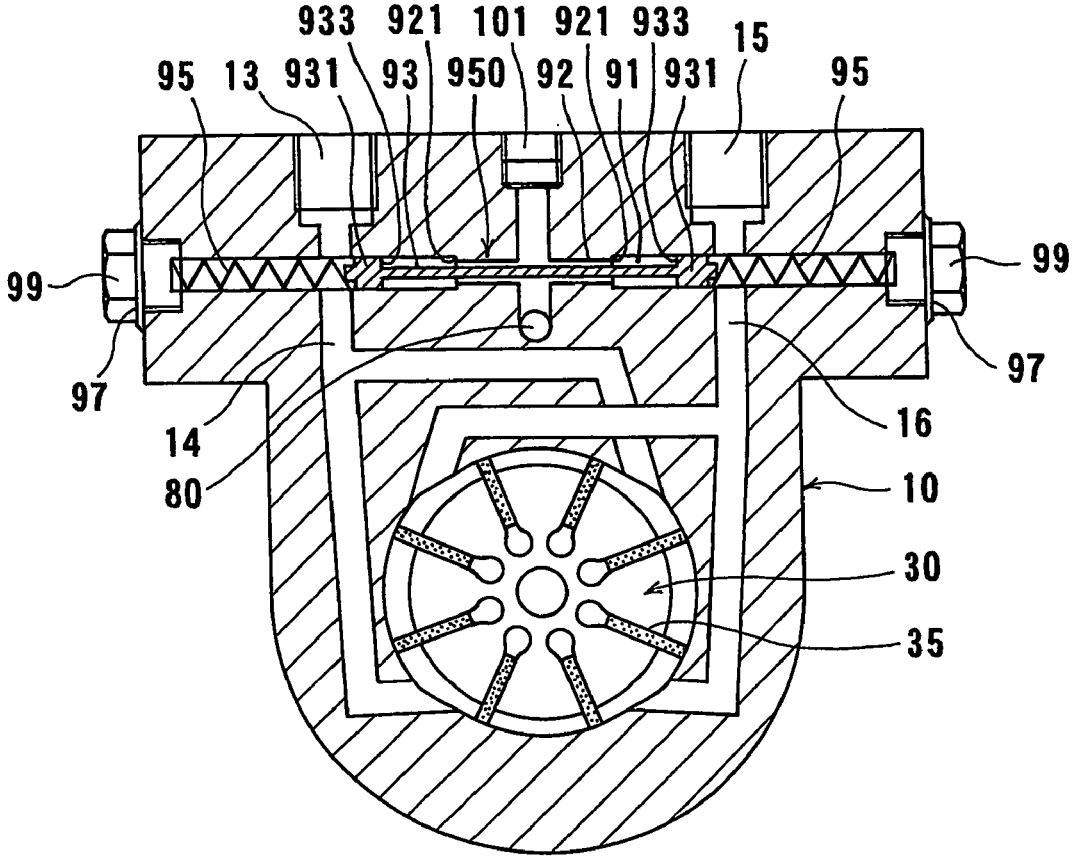
FIG. 4 is a schematic cross-sectional view (corresponding to FIG. 2B) showing a dual-rotation vane-type hydraulic motor 1-2 according to a second embodiment of the present invention.

The second embodiment of the present invention serves to solve the above problems. FIG. 4 is a cross-sectional view (corresponding to FIG. 2B) showing a dual-rotation vane-type hydraulic motor 1-2 according to the second embodiment of the present invention. Those parts of the dual-rotation vane-type hydraulic motor according to the second embodiment which are identical or equivalent to those according to the first embodiment are denoted by identical reference numerals, and will not be described in detail below.

The dual-rotation vane-type hydraulic motor 1-2 according to the second embodiment is different from the dual-rotation vane-type hydraulic motor 1-1 according to the first embodiment in that instead of providing the drain port 17, a port switching mechanism 950 is provided in a cam casing 10. The port switching mechanism 950 has a rod pin insertion hole 91 for allowing a bypass path 80 to communicate with a fluid path 14 of a first port 13 or a fluid path 16 of a second port 15 selectively. A rod pin 93 is slidably disposed in the rod pin insertion hole 91. Two resilient members 95, 95 comprising a spring are disposed in the rod pin insertion hole 91 on both sides of the rod pin 93, respectively. The resilient members 95, 95 press both end portions of the rod pin 93 under equal forces to keep the rod pin 93 in a central position of the rod pin insertion hole 91. The both end portions of the rod pin insertion hole 91 are sealed by respective spring-receiving seats 99, 99 attached to the cam casing 10 through respective seal rings 97, 97.

The rod pin insertion hole 91 has a small-diameter portion 92 provided at a central portion thereof and having a diameter smaller than a diameter of both side portions (large-diameter portions) of the rod pin insertion hole 91. Seal surfaces 921, 921 are formed on both end portions of the small-diameter portion 92, respectively. The small-diameter portion 92 is connected to the bypass path 80. Head portions 931, 931 are provided on the both end portions of the rod pin 93 and have a diameter large enough to close the rod pin insertion hole 91. The head portions 931, 931 have respective seal surfaces 933, 933 formed on their inner confronting surfaces (which face the seal surfaces 921, 921). The rod pin 93 has a connecting portion which connects the head portions 931, 931 to each other and is thin enough to allow the rod pin 93 to move freely in the small-diameter portion 92. The rod pin insertion hole 91 is connected to the bypass path 80 through a hole which is closed by a sealing plug 101.

One end portion of the resilient member 95 is fixed to the spring-receiving seat 99. A pressing force of the resilient member 95 is required to satisfy the following relationship:

[the pressing force (maximum) of the resilient member 95]<[minimum motor-actuating pressure]×[an area of a pressure-receiving surface of the rod pin 93 (the side surface of the head portion 931)]

When the working fluid is not supplied to the first port 13 and the second port 15, the rod pin 93 is held in the central position as shown in FIG. 4.

A diameter of the rod pin 93 is designed such that the rod pin 93 has a strength enough to prevent its deformation such as buckling or its breakage when the rod pin 93 is subjected to the pressing force represented by:

[the pressing force (maximum) of the resilient member 95]+[maximum motor-actuating pressure]×[the area of the pressure-receiving surface of the rod pin 93]

A clearance between the connecting portion of the rod pin 93 and the small-diameter portion 92, and a clearance between the connecting portion of the rod pin 93 and the large-diameter portion of the rod pin insertion hole 91 are designed so as not to develop a back pressure in the fluid path between the bypass path 80 and the first port 13 or between the bypass path 80 and the second port 15 even when the working fluid passes through the bypass path 80 at a maximum flow rate.

Figure 5B:
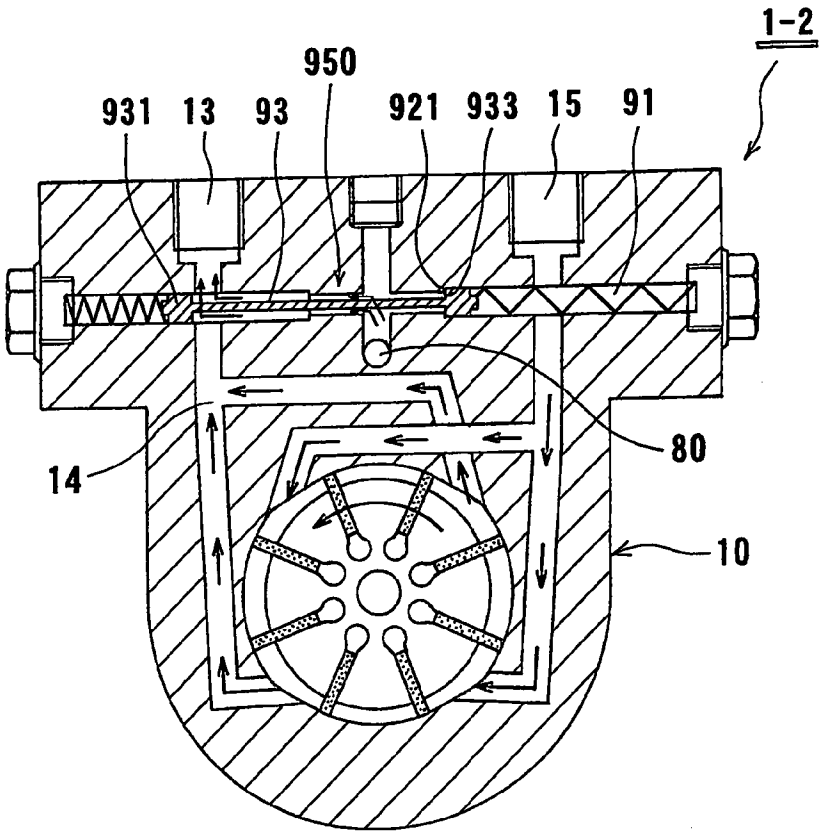
FIG. 5B is a schematic cross-sectional view showing a state in which the vane-type hydraulic motor 1-2 shown in FIG. 4 is rotated in a counterclockwise direction.
Figure 5A:
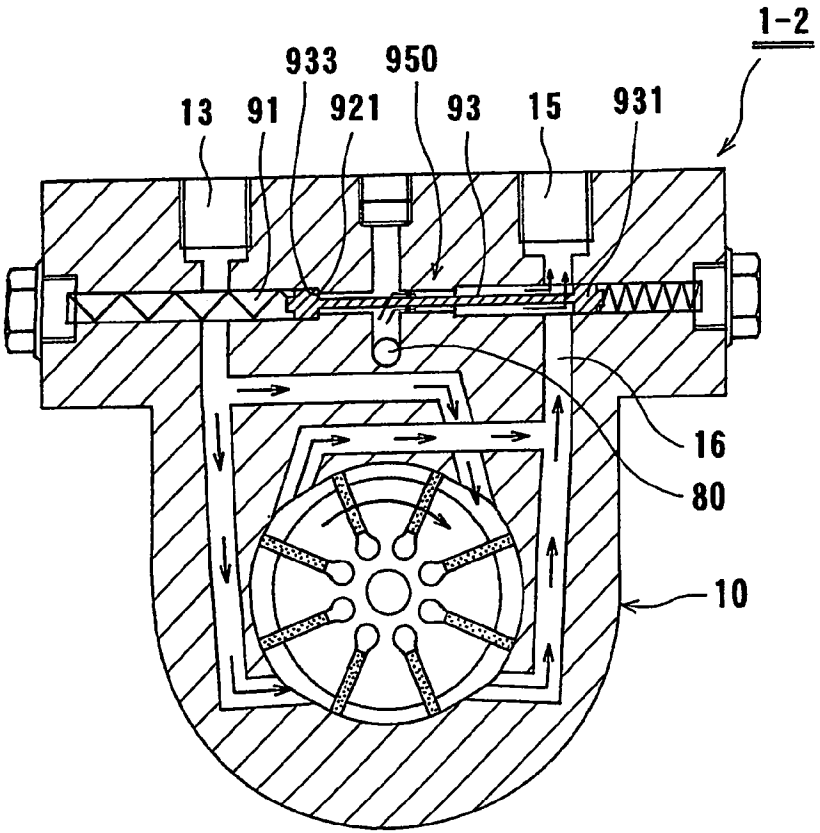
FIG. 5A is a schematic cross-sectional view showing a state in which the vane-type hydraulic motor 1-2 shown in FIG. 4 is rotated in a clockwise direction.

In the case where a supply pipe (not shown) and a return pipe (not shown) are connected to the first port 13 and the second port 15, respectively, such that the first port 13 is used as a supply port for supplying the working fluid and the second port 15 is used as a return port for discharging the working fluid, a pressure of the working fluid at the side of the first port 13 is higher than a pressure of the working fluid at the side of the second port 15. Therefore, as shown in FIG. 5A, the rod pin 93 is moved toward the second port 15 until the left seal surface 921 of the rod pin insertion hole 91 and the left seal surface 933 of the rod pin 93 are brought into face-to-face contact with each other, thereby sealing a contact portion of the left seal surface 921 and the left seal surface 933. Accordingly, the working fluid is prevented from leaking from the side of the first port 13 to the side of the second port 15 through the rod pin insertion hole 91. At this time, the right-side head portion 931 is positioned outwardly of the fluid path 16 connected to the second port 15, thus allowing the bypass path 80 to communicate with the second port 15 (i.e. the return port). Therefore, the working fluid that has passed through the bypass path 80 is returned to the working-fluid storing tank (not shown) through the second port 15.

On the other hand, in the case where the return pipe and the supply pipe are connected to the first port 13 and the second port 15, respectively, such that the first port 13 is used as a return port for discharging the working fluid and the second port 15 is used as a supply port for supplying the working fluid, a pressure of the working fluid at the side of the second port 15 is higher than a pressure of the working fluid at the side of the first port 13. In this case, as shown in FIG. 5B, the rod pin 93 is moved toward the first port 13 until the right seal surface 921 of the rod pin insertion hole 91 and the right seal surface 933 of the rod pin 93 are brought into face-to-face contact with each other, thereby sealing a contact portion of the right seal surface 921 and the right seal surface 933. At this time, the left-side head portion 931 is positioned outwardly of the fluid path 14 connected to the first port 13, thus allowing the bypass path 80 to communicate with the first port 13 (i.e. the return port). Therefore, the working fluid that has passed through the bypass path 80 is returned to the working-fluid storing tank (not shown) through the first port 13.

With the above arrangement, the rotational direction of the motor can easily be changed, and the problems described above can be solved because it is not required to provide an additional port.

A dual-rotation vane-type hydraulic motor according to a third embodiment of the present invention will be described below.

The dual-rotation vane-type hydraulic motor 1-2 according to the second embodiment is required to form a number of complicated fluid paths in the cam casing 10. Therefore, a complicated process is required to form such paths, and it is required to carry out time-consuming maintenance of the vane-type hydraulic motor.

Figure 6:
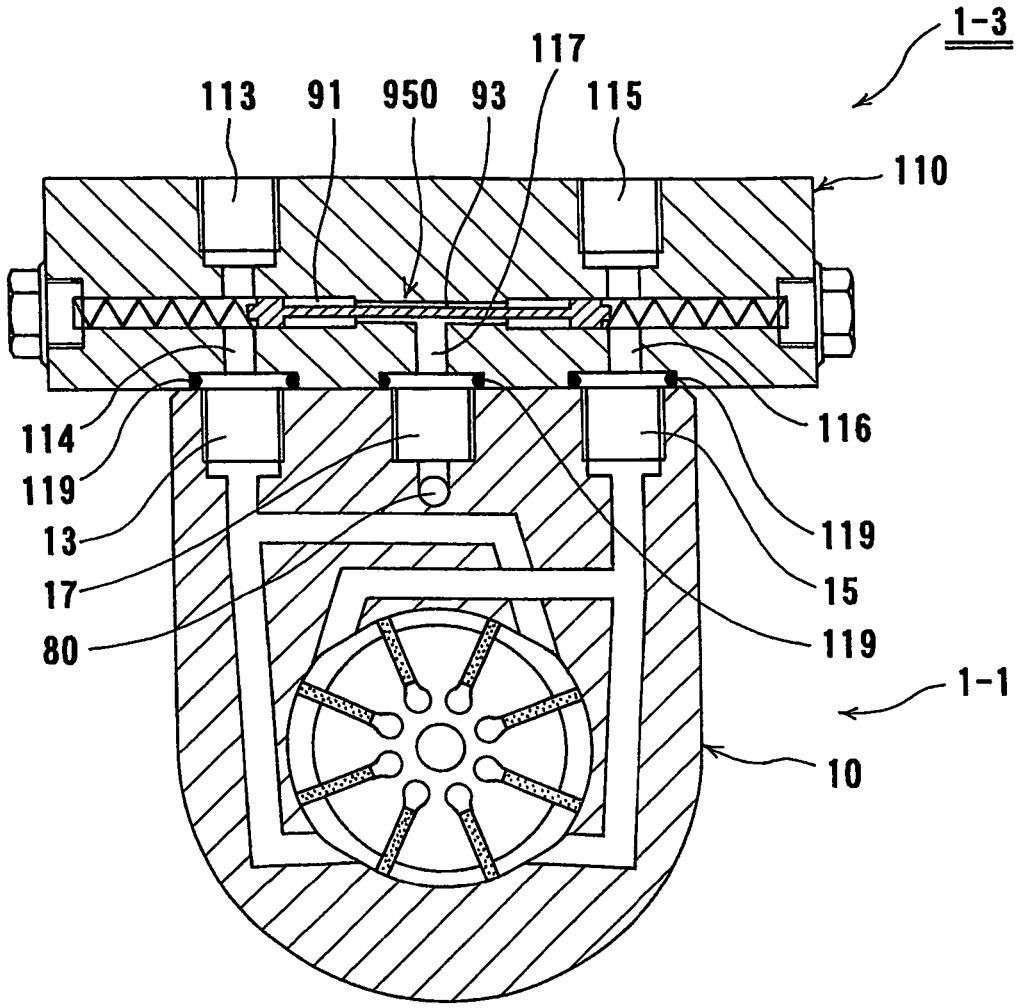
FIG. 6 is a schematic cross-sectional view (corresponding to FIG. 2B) showing a dual-rotation vane-type hydraulic motor 1-3 according to a third embodiment of the present invention.

The third embodiment of the present invention serves to solve the above problems. FIG. 6 is a cross-sectional view (corresponding to FIG. 2B) showing a dual-rotation vane-type hydraulic motor 1-3 according to the third embodiment of the present invention. Those parts of the dual-rotation vane-type hydraulic motor according to the third embodiment which are identical or equivalent to those according to the first and second embodiments are denoted by identical reference numerals, and will not be described in detail below.

The dual-rotation vane-type hydraulic motor 1-3 according to the third embodiment is different from the dual-rotation vane-type hydraulic motors according to the first and second embodiments in that a port switching mechanism 950 according to the second embodiment is incorporated in a block 110 which is separated from a cam casing 10, and the block 110 is mounted on the dual-rotation vane-type hydraulic motor 1-1 according to the first embodiment. Specifically, the block 110 has a third port 113 and a fourth port 115 defined therein which open on one side of the block 110, and also has communication holes 114, 116 defined therein which open on the opposite side of the block 110. In addition, a communication hole 117 is provided in the block 110 at a position between the communication hole 114 and the communication hole 116. The port switching mechanism 950 has the same structure as the port switching mechanism according to the second embodiment. The port switching mechanism 950 has a rod pin insertion hole 91 for allowing a bypass path 80 to communicate with the third port 113 or the fourth port 115 selectively. A rod pin 93 is slidably inserted in the rod pin insertion hole 91. Depending on a differential pressure of the working fluid between the third port 113 and the fourth port 115, the rod pin 93 is moved to allow the communication hole 117 to communicate with a low-pressure one of the third port 113 and the fourth port 115. The block 110 is mounted on the vane-type hydraulic motor 1-1 having the same structure as the vane-type hydraulic motor according to the first embodiment. The block 110 is fixed to the vane-type hydraulic motor 1-1 by a fixing device (not shown), thus completing the vane-type hydraulic motor 1-3. The communication holes 114, 116 and 117 are connected to the first port 13, the second port 15, and the drain port 17, respectively. Junctions between the communication holes 114, 116 and 117, and the first port 13, the second port 15, and the drain port 17 are sealed by seal members 119 such as O-rings, respectively.

In a neutral state shown in FIG. 6, in the case where a supply pipe (not shown) and a return pipe (not shown) are connected to the third port 113 and the fourth port 115, respectively, such that the working fluid is supplied into the third port 113 and the working fluid is discharged from the fourth port 115, a pressure of the working fluid at the side of the third port 113 is higher than a pressure of the working fluid at the side of the fourth port 115. Therefore, the rod pin 93 is moved toward the fourth port 115, and hence the bypass path 80 and the fourth port 115 (i.e. the return port) communicate with each other. Accordingly, the working fluid that has passed through the bypass path 80 is returned to a working-fluid storing tank (not shown) through the fourth port 115.

On the other hand, in the case where the return pipe and the supply pipe are connected to the third port 113 and the fourth port 115, respectively, such that the third port 113 is used as a return port and the fourth port 115 is used as a supply port, a pressure of the working fluid at the side of the fourth port 115 is higher than a pressure of the working fluid at the side of the third port 113. Therefore, the rod pin 93 is moved toward the third port 113, and hence the bypass path 80 and the third port 113 (i.e. the return port) communicate with each other. Accordingly, the working fluid that has passed through the bypass path 80 is returned to the working-fluid storing tank (not shown) through the third port 113.

With the above arrangement, the rotational direction of the motor can easily be changed, and the pipes can be installed easily and simply because it is not required to provide an additional port. Since the cam casing 10 and the block 110 can be manufactured as separate components, the manufacturing process can be simplified, thus reducing the manufacturing cost. Additionally, the maintenance of the vane-type hydraulic motor can easily be carried out.

Various seal structures provided by the seal surface 933 and the seal surface 921 will be described below with reference to FIGS. 7A through 9B.

If a low-viscosity fluid such as water leaks from a gap, the leakage from the gap is large because of the physical property of the low-viscosity fluid even if the gap is small. Therefore, if such a low-viscosity fluid is used as a working fluid, it is necessary to seal the gap securely so as not to cause the leakage of the low-viscosity fluid from the gap. The seal surface 933 of the rod pin 93 and the seal surface 921 of the rod pin insertion hole 91 are arranged to provide various seal structures as described below.

Figure 7A:
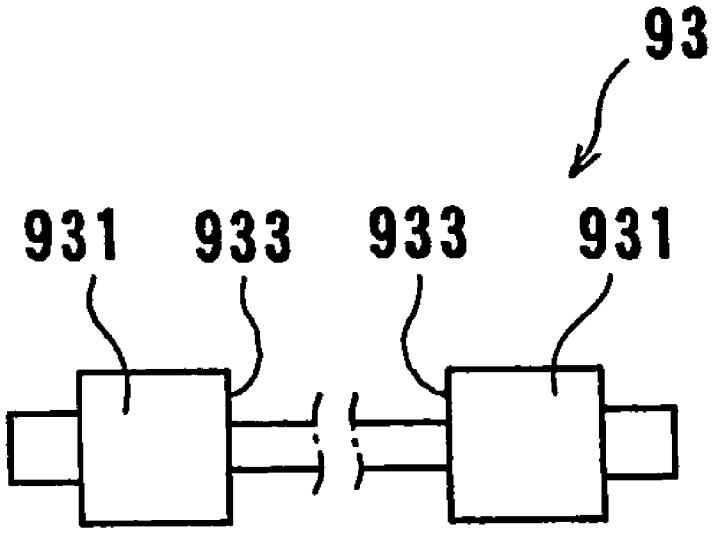
FIG. 7A is a view showing an example of a structure of a rod pin 93 incorporated in a port switching mechanism according to the second and third embodiments of the present invention.
Figure 7B:
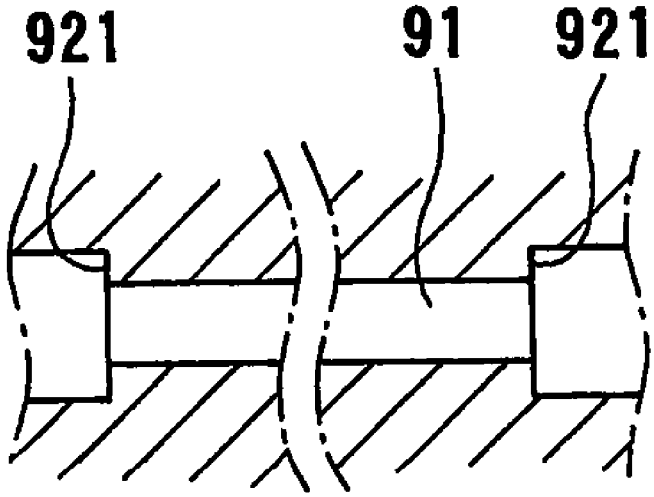
FIG. 7B is a view showing an example of a structure of a rod pin insertion hole 91 for receiving the rod pin 93 inserted therein.

FIG. 7A is a schematic view showing an example of a structure of the rod pin 93, and FIG. 7B is a schematic view showing an example of a structure of the rod pin insertion hole 91 for receiving the rod pin 93 inserted therein. As shown in FIG. 7A, the head portions 931, 931 of the rod pin 93 have flat seal surfaces 933, 933, respectively, and as shown in FIG. 7B, the rod pin insertion hole 91 has flat seal surfaces 921, 921. With this structure, the seal surface 921 and the seal surface 933 are brought into face-to-face contact with each other, thereby providing a reliable sealing.

Figure 8A:
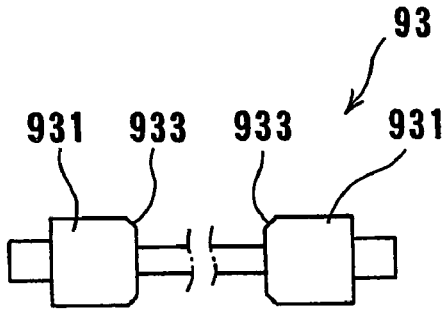
FIG. 8A is a view showing another example of a structure of the rod pin 93.
Figure 8B:
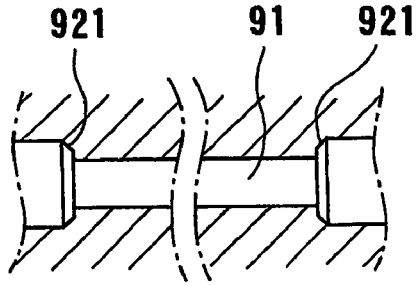
FIG. 8B is a view showing another example of a structure of the rod pin insertion hole 91 for receiving the rod pin 93 inserted therein.

FIG. 8A is a schematic view showing another example of a structure of the rod pin 93, and FIG. 8B is a schematic view showing another example of a structure of the rod pin insertion hole 91 for receiving the rod pin 93 inserted therein. As shown in FIG. 8A, the head portions 931, 931 of the rod pin 93 have tapered seal surfaces 933, 933, respectively, and as shown in FIG. 8B, the rod pin insertion hole 91 has tapered seal surfaces 921, 921 whose shape corresponds to the shape of the seal surfaces 933, 933 of the rod pin 93. With this structure, the seal surface 921 and the seal surface 933 are brought into face-to-face contact with each other. The tapered seal surfaces 921, 933 provide a contact area larger than that of the flat seal surfaces 921, 933 shown in FIGS. 7A and 7B, thus further increasing a sealing capability.

Figure 9A:
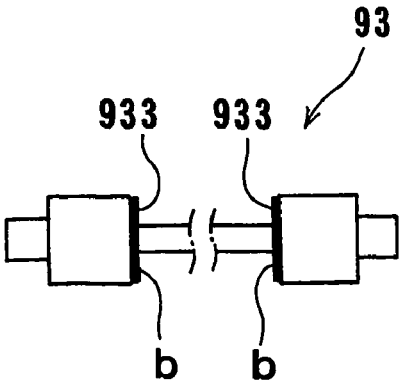
FIG. 9A is a view showing another example of a structure of the rod pin 93 having a flat resilient member.
Figure 9B:
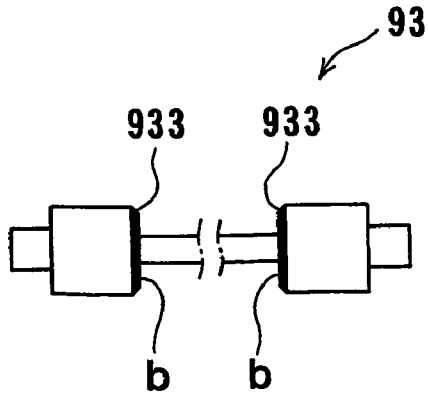
FIG. 9B is a view showing another example of a structure of the rod pin 93 having a tapered resilient member.

FIGS. 9A and 9B are schematic views showing another example of a structure of the rod pin 93. In this example, seal surfaces 933, 933 of the rod pin 93 comprise a resilient member b joined to the rod pin 93. The resilient member b may be made of plastic, rubber, or the like. The seal surface 933 shown in FIG. 9A has a flat shape, and the seal surface 933 shown in FIG. 9B has a tapered shape. With this structure, a sealing capability is further increased. The seal surface 921 of the rod pin insertion hole 91, rather than the seal surface 933 of the rod pin 93, may comprise a resilient member, or both the seal surface 933 and the seal surface 921 may comprise a resilient member.

Various structures of the head portion 931 of the rod pin 93 will be described blow with reference to FIGS. 10A through 11B.

Figure 10A:
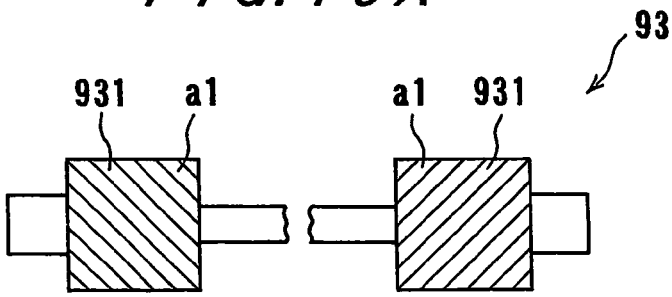
FIG. 10A is a view showing an example of a structure of the rod pin 93 whose head portion 931 comprises a low-friction member a1 for allowing the rod pin 93 to move smoothly.
Figure 10B:
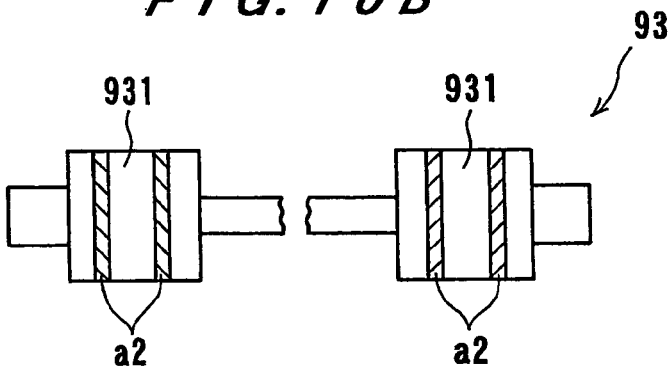
FIG. 10B is a view showing an example of a structure of the rod pin 93 whose head portion 931 has a ring-shaped low-friction member a2 for allowing the rod pin 93 to move smoothly.

A low-viscosity fluid such as water has a poor lubricity. Therefore, it is necessary to provide a measure for allowing the rod pin 93 to move smoothly. In FIG. 10A, the head portions 931, 931 of the rod pin 93 comprise a low-friction member a1 made of ceramic, resin, or the like which has a low-friction property and a high wear-resistance property in a water lubricating environment. In FIG. 10B, two ring-shaped low-friction members a2 are attached to an outer circumferential surface (a sliding contact portion) of the head portion 931 of the rod pin 93. The ring-shaped low-friction member a2 extends in a circumferential direction of the head portion 931. The low-friction member a1 and the ring-shaped low-friction member a2 improve the lubricity of the outer circumferential surface of the head portion 931 which is brought into sliding contact with the inner circumferential surface of the rod pin insertion hole 91, and hence the rod pin 93 can move smoothly in the rod pin insertion hole 91. Although two ring-shaped low-friction members a2 are attached to the head portion 931 as shown in FIG. 10B, more than two ring-shaped low-friction members a2 or less than two ring-shaped low-friction members a2 may be attached to the head portion 931. The low-friction member is not limited to the shapes and structures described above, but may have various other shapes and structures. The low-friction member may comprise a coating applied to the circumferential surface of the head portion 931.

Figure 11A:
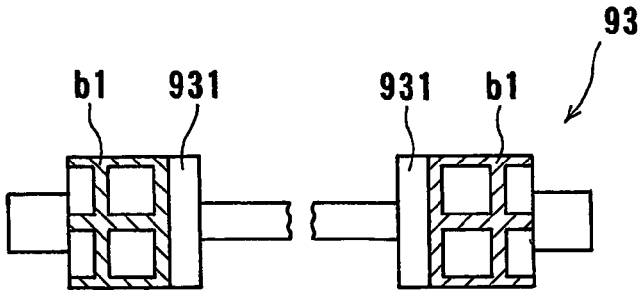
FIG. 11A is a view showing an example of a structure of the rod pin 93 whose head portion 931 has a friction-reducing groove b1 extending rectangularly for allowing the rod pin 93 to move smoothly.
Figure 11B:
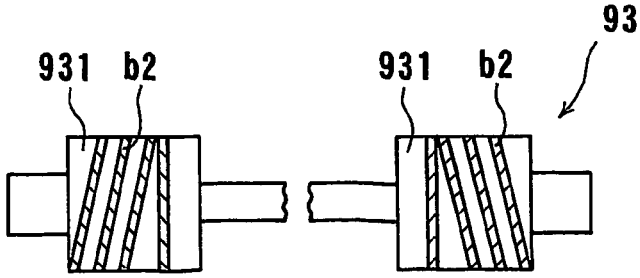
FIG. 11B is a view showing an example of a structure of the rod pin 93 whose head portion 931 has a friction-reducing groove b2 extending spirally for allowing the rod pin 93 to move smoothly.

In order to accelerate the lubrication of the outer circumferential surface of the head portion 931 serving as a sliding contact portion, friction-reducing grooves b1, b2 may be formed on the outer circumferential surface of the head portion 931, as shown in FIGS. 11A and 11B. In FIG. 11A, the friction-reducing groove b1 extends rectangularly to form a rectangular pattern. In FIG. 11B, the friction-reducing groove b2 extends spirally to form a spiral pattern. The friction-reducing groove is not limited to the above patterns, but may be formed in any of various patterns insofar as those patterns are capable of accelerating the lubrication of the circumferential surface of the head portion 931. The low-friction members a1, a2 shown in FIGS. 10A and 10B may be combined with the friction-reducing grooves b1, b2 shown in FIGS. 11A and 11B for thereby allowing the rod pin 93 to move further smoothly.

According to the present invention, the following advantages can be obtained:

(1) The drain port for discharging the working fluid to the exterior is provided in addition to the first port and the second port. The drain port and the bypass path communicate with each other, and the working fluid, that has leaks through the bearing portion, is discharged from the drain port to the exterior. With this structure, even when the working fluid is supplied to or discharged from the first port or the second port, the working fluid passing through the bypass path is discharged from the drain port at all times. Therefore, the rotor can be rotated in one direction and the opposite direction. That is, even if the supply direction (or discharge direction) of the working fluid to the first port or the second port is switched, the working fluid can be drained from the bypass path to the drain port, and hence the rotor can be rotated selectively in both directions.

(2) Since the cam casing has the port switching mechanism incorporated therein, the number of pipes connected to the cam casing is not increased. Therefore, the piping can be arranged even when the vane-type hydraulic motor is installed in a limited space, and the installation cost of the pipes can be reduced.

(3) Because the vane-type hydraulic motor comprises the block having the port switching mechanism therein, the cam casing and the block constituting the vane-type hydraulic motor can be manufactured as separate components. As a result, the manufacturing process can be simplified, the manufacturing cost can be reduced, and the maintenance of the vane-type hydraulic motor can easily be carried out.

(4) The seal surface of the rod pin and the seal surface of the rod pin insertion hole comprise a flat or tapered surface. Therefore, such seal surfaces are brought into face-to-face contact with each other, thus sealing the working fluid securely even if the working fluid comprises a low-viscosity fluid.

INDUSTRIAL APPLICABILITY

The present invention is applicable to a vane-type hydraulic motor, and more particularly to a vane-type hydraulic motor which uses a low-viscosity fluid such as water as a working fluid.

The invention claimed is:

1. A vane-type hydraulic motor comprising:

a rotor having a main shaft and a plurality of vanes;

a cam casing having a chamber for rotatably housing said rotor;

a first port and a second port for supplying a working fluid into said chamber and discharging the working fluid from said chamber;

a bypass path for allowing the working fluid to flow from a bearing portion supporting said main shaft through said bypass path; and a drain port for discharging the working fluid to the exterior;

wherein said drain port and said bypass path communicate with each other to allow the working fluid flowing from said bearing portion through said bypass path to be discharged from said drain port to the exterior.

2. A vane-type hydraulic motor according to claim 1, further comprising:

a block having a third port and a fourth port which communicate with said first port and said second port, respectively; and a port switching mechanism provided in said block for switching a flow direction of the working fluid to allow said bypass path to communicate with a low-pressure one of said third port and said fourth port.

3. A vane-type hydraulic motor according to claim 2, wherein said port switching mechanism comprises a rod pin insertion hole provided in said block and communicating with said bypass path, and a rod pin slidably inserted in said rod pin insertion hole, and said rod pin is moved depending on a differential pressure of the working fluid between said third port and said fourth port to allow said bypass path to communicate with a low-pressure one of said third port and said fourth port.

4. A vane-type hydraulic motor according to claim 3, wherein said rod pin insertion hole has a small-diameter portion having seal surfaces at both end portions thereof, said rod pin has seal surfaces facing said seal surfaces of said small-diameter portion, respectively, and when said rod pin is moved toward a low-pressure side, said seal surface of said rod pin at a high-pressure side is brought into contact with said seal surface of said small-diameter portion at a high-pressure side.

5. A vane-type hydraulic motor according to claim 4, wherein said seal surfaces of said small-diameter portion and said seal surfaces of said rod pin have a flat shape or a tapered shape.

6. A vane-type hydraulic motor according to claim 4 or 5, wherein at least one of said seal surfaces of said rod pin and said seal surfaces of said small-diameter portion comprises a resilient member.

7. A vane-type hydraulic motor according to claim 3, wherein at least a part of a surface of said rod pin which is brought into sliding contact with an inner circumferential surface of said rod pin insertion hole comprises a low-friction member.

8. A vane-type hydraulic motor according to claim 3, wherein said rod pin which is brought into sliding contact with an inner circumferential surface of said rod pin insertion hole has a groove.

9. A vane-type hydraulic motor comprising:

a rotor having a main shaft and a plurality of vanes;

a cam casing having a chamber for rotatably housing said rotor;

a first port and a second port for supplying a working fluid into said chamber and discharging the working fluid from said chamber;

a bypass path for allowing the working fluid to flow from a bearing portion supporting said main shaft through said bypass path; and a port switching mechanism for switching a flow direction of the working fluid to allow said bypass path to communicate with a low-pressure one of said first port and said second port.

10. A vane-type hydraulic motor according to claim 9, wherein said port switching mechanism comprises a rod pin insertion hole provided in said cam casing and communicating with said bypass path, and a rod pin slidably inserted in said rod pin insertion hole, and said rod pin is moved depending on a differential pressure of the working fluid between said first port and said second port to allow said bypass path to communicate with a low-pressure one of said first port and said second port.

11. A vane-type hydraulic motor according to claim 10, wherein said rod pin insertion hole has a small-diameter portion having seal surfaces at both end portions thereof, said rod pin has seal surfaces facing said seal surfaces of said small-diameter portion, respectively, and when said rod pin is moved toward a low-pressure side, said seal surface of said rod pin at a high-pressure side is brought into contact with said seal surface of said small-diameter portion at a high-pressure side.

12. A vane-type hydraulic motor according to claim 11, wherein said seal surfaces of said small-diameter portion and said seal surfaces of said rod pin have a flat shape or a tapered shape.

13. A vane-type hydraulic motor according to claim 11 or 12, wherein at least one of said seal surfaces of said rod pin and said seal surfaces of said small-diameter portion comprises a resilient member.

14. A vane-type hydraulic motor according to claim 10, wherein at least a part of a surface of said rod pin which is brought into sliding contact with an inner circumferential surface of said rod pin insertion hole comprises a low-friction member.

15. A vane-type hydraulic motor according to claim 10, wherein said rod pin which is brought into sliding contact with an inner circumferential surface of said rod pin insertion hole has a groove.

* * * * *

UNITED STATES PATENT AND TRADEMARK OFFICE

CERTIFICATE OF CORRECTION

PATENT NO. : 7,273,360 B2
APPLICATION NO. : 10/525009
DATED : September 25, 2007
INVENTOR(S) : Masao Shinoda et al.

It is certified that error appears in the above-identified patent and that said Letters Patent is hereby corrected as shown below:

On the Title Page:

In Item (75) change "Chishiro YAMASHITA" to be --Chishiro YAMASHINA--.

Signed and Sealed this

Eleventh Day of March, 2008

JON W. DUDAS
*Director of the United States Patent and Trademark Office*